US007592887B2

(12) United States Patent
Chao et al.

(10) Patent No.: US 7,592,887 B2
(45) Date of Patent: Sep. 22, 2009

(54) WAVEGUIDE INTERFACE HAVING A CHOKE FLANGE FACING A SHIELDING FLANGE

(75) Inventors: Yen-Fang Chao, Pleasanton, CA (US); Bruce Corkill, Lower Hutt (NZ); Eric Tiongson, Daly City, CA (US); John Ruiz, San Jose, CA (US)

(73) Assignee: Harris Stratex Networks Operating Corporation, Morrisville, NC (US)

( * ) Notice: Subject to any disclaimer, the term of this patent is extended or adjusted under 35 U.S.C. 154(b) by 136 days.

(21) Appl. No.: 11/479,893

(22) Filed: Jun. 30, 2006

(65) Prior Publication Data

US 2008/0001686 A1 Jan. 3, 2008

(51) Int. Cl.
*H01P 1/04* (2006.01)

(52) U.S. Cl. ..... 333/254

(58) Field of Classification Search ..... 333/254, 333/255, 256, 257

See application file for complete search history.

(56) References Cited

U.S. PATENT DOCUMENTS 2,962,677 A * 11/1960 Edwards ..... 333/256
4,199,764 A 4/1980 Williams et al.
4,861,955 A 8/1989 Shen
4,879,534 A 11/1989 Spinner
5,231,414 A 7/1993 Ladds
5,781,087 A 7/1998 Milroy et al.
5,808,528 A 9/1998 Griffith et al.
5,910,754 A 6/1999 Simpson et al.
6,064,862 A 5/2000 Grenon et al.
6,977,561 B2 12/2005 Freeman

OTHER PUBLICATIONS

H. S. Lee, W. H. Hwang, S. H. Kim, M. H. Cho, I. S. Ko and W. Namkung, "RF Test Results Of Choke Flange For High Power Waveguide Valves," Pohang Accelerator Laboratory, Postech, 1998, Pohang 790-784, Korea, 3 pages.

PCT International Search Report and Written Opinion dated Aug. 26, 2008, for International Application No. PCT/US2007/013508, 11 pages.

* cited by examiner

*Primary Examiner*—Benny Lee
(74) *Attorney, Agent, or Firm*—Sheppard, Mullin, Richter & Hampton LLP

(57) ABSTRACT

Waveguide flanges for joining waveguide sections or components are designed to achieve mechanical strength and exhibit desired electrical properties such as relatively low insertion loss and high return loss. The present invention contemplates waveguide interfaces with a new choke flange designed to engage with a shield flange and provide a joint with improved electrical properties. The new choke designs produce a virtual continuity through the waveguide joints and minimize electrical energy leakage. The electrical and mechanical properties of the joint in the waveguide interfaces are robust and able to tolerate lower levels of parts precision, imperfect mating of the flanges without metal-to-metal contact and gaps up to 0.06" or more between the mating flange surfaces.

12 Claims, 13 Drawing Sheets

A - A

WAVEGUIDE INTERFACE HAVING A CHOKE FLANGE FACING A SHIELDING FLANGE

FIELD OF THE INVENTION

This application relates to waveguide systems and, more specifically, to waveguide interfaces for coupling sections of waveguide and waveguide components.

BACKGROUND

Waveguide flanges are used for coupling waveguide sections and waveguide components. When designing waveguide flanges for waveguide joints, consideration is given to the fact that characteristics of waveguide joints affect the mechanical strength and electrical performance of waveguides. For this reason waveguide joints are designed to provide strength and minimize energy reflections and minimal power leakage throughout the frequency range.

Ideally, flat flanges butted together with perfect ohmic contact would produce negligible reflections and negligible power leakage that are frequency insensitive. With a perfect contact-type coupling of flat flanges the waveguide is essentially continuous through the joint. However, a perfect ohmic contact to prevent leakage and reflection requires precise alignment, clean and perfectly flat surfaces and a tight face-to-face surface abutment.

With careful design and assembly, the combined waveguide sections or components are more likely to exhibit desired SWR (standing wave ratio), return loss, reflection and leakage properties over the frequency range. However, flat contact-type flanges cannot tolerate gaps between them and, being susceptible to mechanical vibrations or surface degradation, at higher levels of energy they can produce arcing at the joints. For the same reason, flat contact-type flanges are not suitable for coaxial and rotary joints.

As an alternative, waveguide joints use choke flanges. In a typical configuration, The connection between the waveguide sections is accomplished with a cover flange 14 abutting a choke flange 16 as shown in FIGS. 1*a*-1*c*. In the choke flange 16, a circular groove 12 forming a half-wave low-impedance line is inserted, at the joint, in series with the waveguide. The depth of the groove and its radius are each a quarter wavelength (i.e., $\lambda/4$) as shown in FIG. 1*a*. With the quarter wave dimension of the groove the current at the contact points 22 (see FIG. 1*a*) is substantially zero because any finite resistance at the contact points is in series with infinite impedance. With the dimension of the groove radius being also quarter wave, the impedance at the contact points is substantially zero and provides continuity of the longitudinal current flow between the waveguides sections 18,20 (along the side walls). In other words, because the series line is short-circuited at the far end its input impedance is negligible and the two waveguide sections are essentially continuous through the joint. The actual ohmic contact between the flanges is made at the half-wavelength line where there is a current node and, thus, leakage and energy reflections can be minimized. Additionally, the low characteristic impedance of the half wavelength line over the frequency range reduces frequency sensitivity, but in designing such choke, care must be given to the appropriate wavelength.

FIG. 2 illustrates a coaxial rotary waveguide joint. In its conventional form, a rotary joint is made with a pair of axially aligned flanges and the electrical connection is made with low-resistance contacts. In the illustrated coaxial rotary joint, a DC-blocking connection joins the inner conductors 106, 108 and the outer conductors 102, 104 are joined together by choke-configured connections 112.

However, conventional choke-coupled joints such as those illustrated above require precise alignment and high precision parts. This requirement is particularly important at high frequencies, for example at 38 GHz. For rotary joints the precise alignment prevents return loss and SWR variations and minimizes friction during rotation. To illustrate this point, FIGS. 3*a*-3*b* show the cover flange 202 of a choke-coupled joint with spring contacts 222 for mating the waveguides sections 218, 220. These additional components (spring contacts) are necessary to secure ohmic contact between the waveguide sections.

SUMMARY OF THE INVENTION

The present invention contemplates waveguide interface designs that address these and related issues. Interfaces for joining waveguides that are designed in accordance with the principles of the present invention exhibit desired electrical properties even with imperfect face-to-face surface abutment or alignment. These waveguide interfaces tolerate gaps between the mating surfaces of the flanges, as much as 0.06" or more, and lower levels of parts precision. The waveguide transition is designed to minimize resonance that would otherwise introduce poor return loss and high insertion loss. This property is optimized for the entire frequency band. In addition, these waveguide interfaces require fewer parts, having no need for the spring or contacts to make the ohmic contact.

Accordingly, for the purpose of the invention as shown and broadly described herein a waveguide interface includes a choke flange associated with a waveguide and a shield flange associated with another waveguide. In one embodiment, the choke flange has a body with a perimeter and a base and a neck that forms a step at the base around the perimeter of the body. The neck is typically substantially concentric with the body. At the base, the neck has a mating face with a waveguide opening for the associated waveguide, wherein for a design frequency the body and the neck conceptually have half-wavelength and quarter wavelength dimensions, respectively, that correspond to the design frequency. The quarter wavelength dimension of the neck is its radius, or half of its width or length dimension.

In this embodiment of waveguide interface, the shield flange has a mating face with a waveguide opening for the other waveguide. The shield flange is adapted to receive the choke flange whereby the waveguide openings would face each other and the associated waveguides would be coupled. The waveguide openings are each circular, rectangular or square shaped to accommodate the shape of their associated waveguide. The shield flange and step formed by the neck and body of the received choke flange define an air gap that has the effect of creating a virtual continuity through the joint between the coupled waveguides even when the face-to-face abutment is not perfect so that the waveguide openings end up with a gap of, say, 0.06" between them. Indeed, a waveguide interface can be adapted to maintain a loose coupling between the shield and choke flanges such that air is passable therebetween. The virtual continuity through the joint represents matched impedance across the joint and this translates to matched frequency response.

Then, for various gap sizes, over the frequency band the joint between the waveguides would exhibit insertion loss that falls below a predetermined insertion loss level, say, 1 dB, and return loss that exceeds a predetermined return loss level, say, 20 dB. Preferably also, the shield flange is adapted with shield walls that project from its base sufficiently so as to create mechanical support for retaining the received choke flange and to create an electrical block for preventing energy leakage. That is, with this configuration the waveguide interface would produce negligible reflections and negligible power leakage that are frequency insensitive.

In another embodiment of the waveguide interface, the choke flange has a body with a wall that defines its perimeter and a base that includes a mating face with an opening for the waveguide. The wall has, around the perimeter, an annular groove which is offset from the base. For a design frequency the groove has a width dimension that corresponds to half wavelength of the design frequency. In this embodiment, the shield flange again has a mating face with a waveguide opening for the other waveguide and it is adapted to engage the choke flange whereby the waveguide openings would face each other and the associated waveguides would be coupled. The shield flange and engaged choke flange with the groove define an air gap that has the effect of creating a virtual continuity across the joint between the coupled waveguides even when the waveguide openings have a gap therebetween.

In sum, a waveguide interface designed in accordance with principles of the present invention exhibits improved mechanical and electrical properties. This and other features, aspects and advantages of the present invention will become better understood from the description herein, appended claims, and accompanying drawings as hereafter described.

BRIEF DESCRIPTION OF THE DRAWINGS

The accompanying drawings, which are incorporated in and constitute a part of this specification, illustrate various aspects of the invention and together with the description, serve to explain its principles. Wherever convenient, the same reference numbers will be used throughout the drawings to refer to the same or like elements.

DETAILED DESCRIPTION OF THE INVENTION

As noted above, the present invention relates to waveguide interfaces. The design of waveguide interfaces in accordance with the present invention is based, in part, on the observation that, with proper geometry, a half-wave groove at the connection point between two waveguides appears to the passing waves as a virtual continuity through the joint in the transmission line.

Figure 1A:
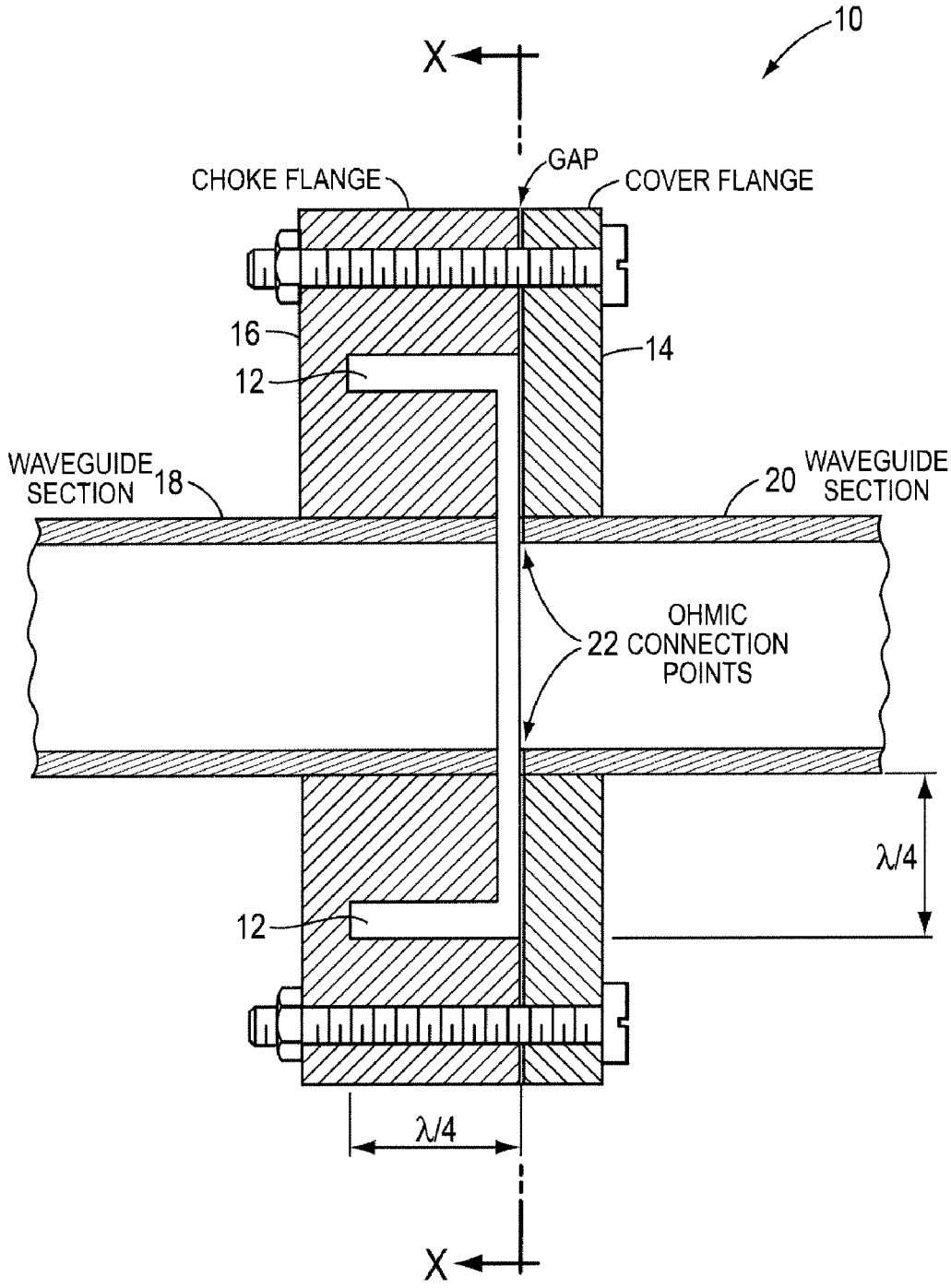
FIG. 1a (PRIOR ART)
FIGS. 1*a*-1*c* illustrate a typical waveguide interface configured with a cover flange abutting a choke flange to form the joint between waveguide sections.
Figure 1B:
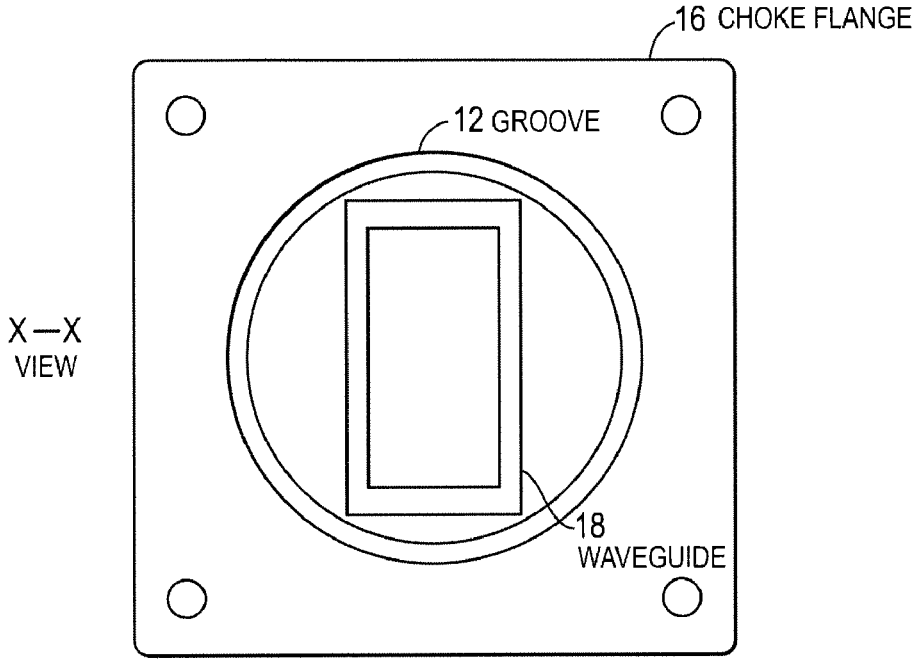
FIG. 1b (PRIOR ART)
Figure 1C:
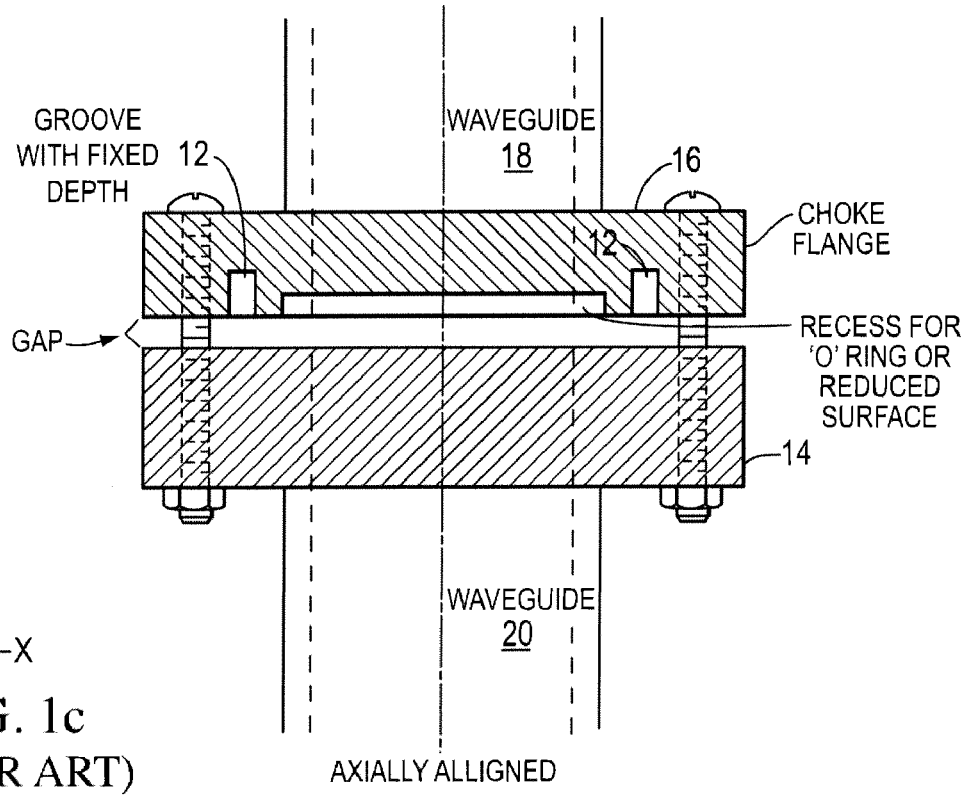
FIG. 1c (PRIOR ART)
Figure 2:
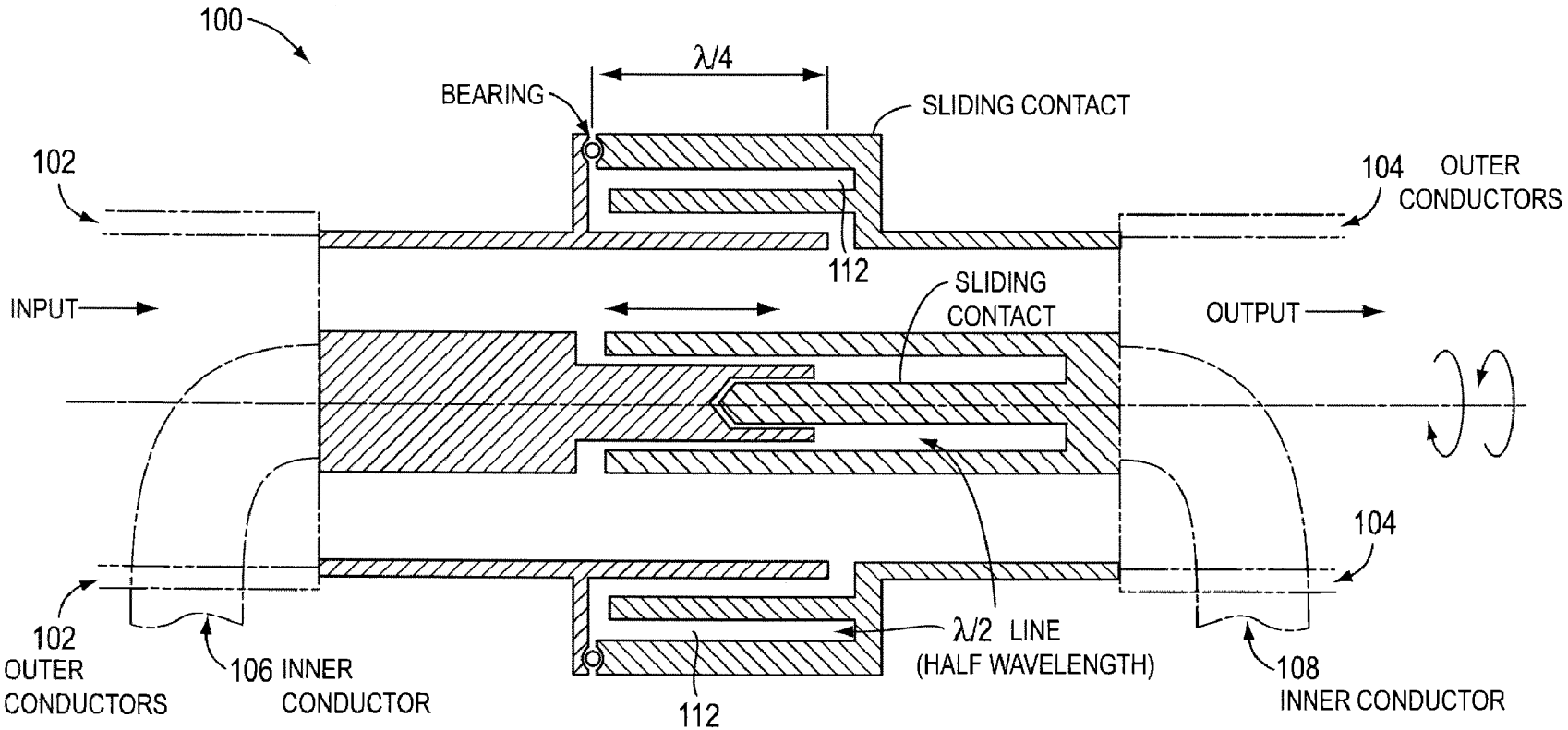
FIG. 2 (PRIOR ART)
FIG. 2 illustrates a prior art coaxial rotary waveguide joint.
Figure 3A:
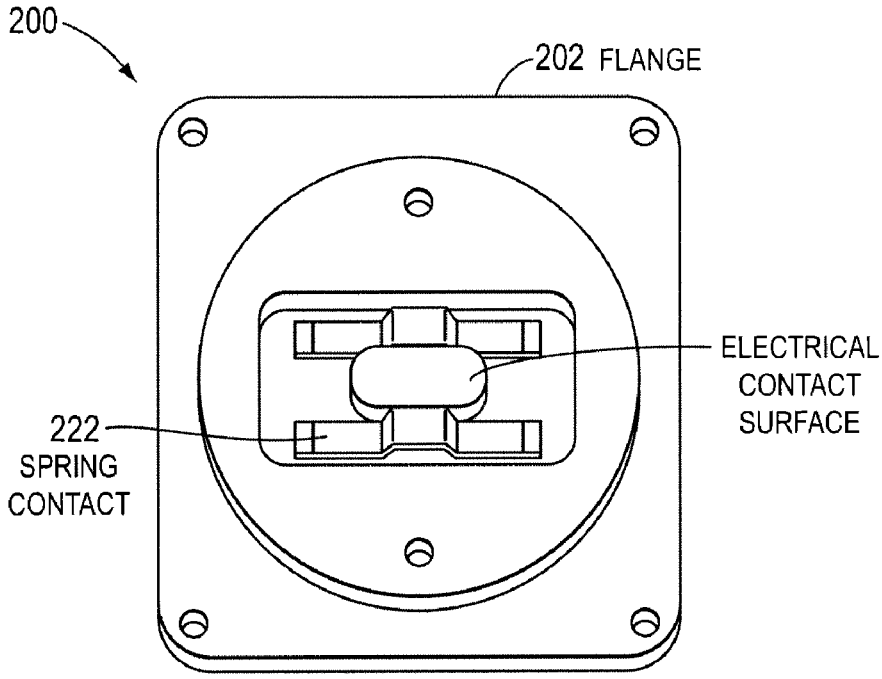
FIG. 3a (PRIOR ART)
FIGS. 3*a*-3*b* show the cover flange of a choke-coupled waveguide joint with spring contacts for mating the waveguides.
Figure 3B:
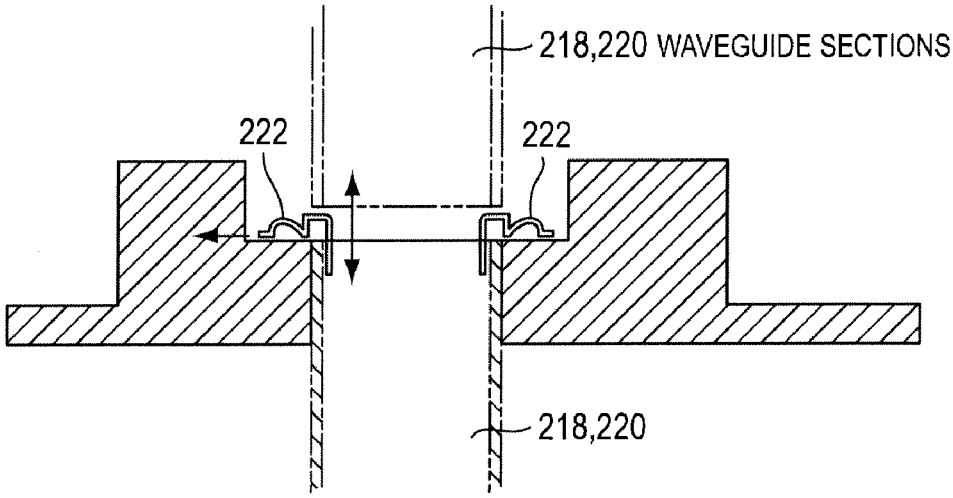
FIG. 3b (PRIOR ART)
Figure 4A:
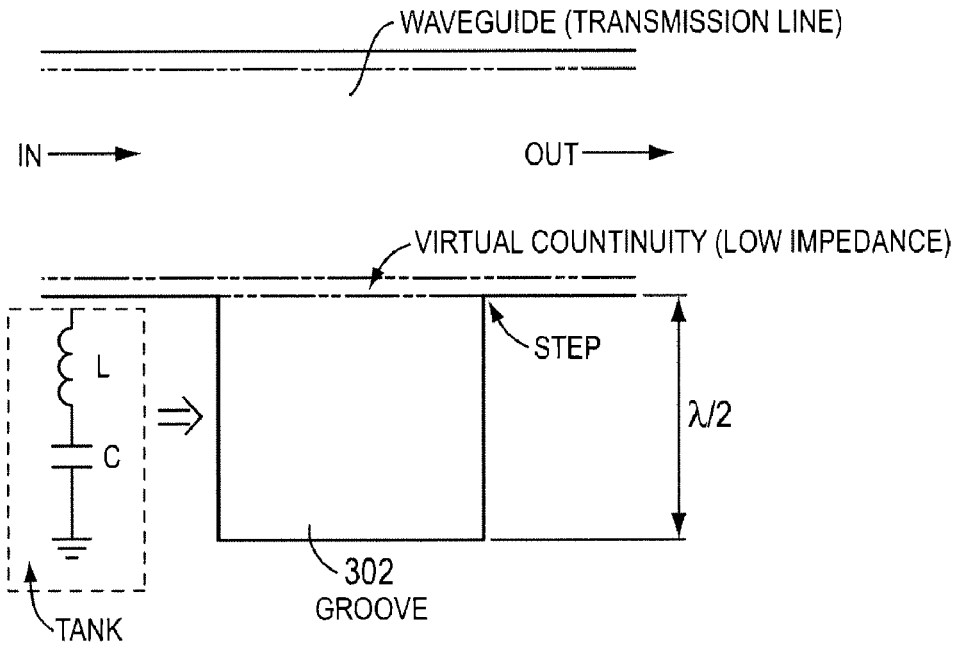
FIGS. 4*a*-4*b* illustrate the properties of a half-wave groove at the connection point and the resonance frequency of the equivalent tank circuit within the frequency band.

FIG. 4*a* illustrates the foregoing principle. The transmission line is interrupted with a groove 302 having a half-wavelength dimension (λ/2). The groove is analogous to a tank circuit with inductance, L, and capacitance, C. The resonance frequency, fc, of the analogous tank circuit is derived from the equation:

$$fc = \frac{1}{2\pi\sqrt{LC}}. \qquad 1.$$

Figure 4B:
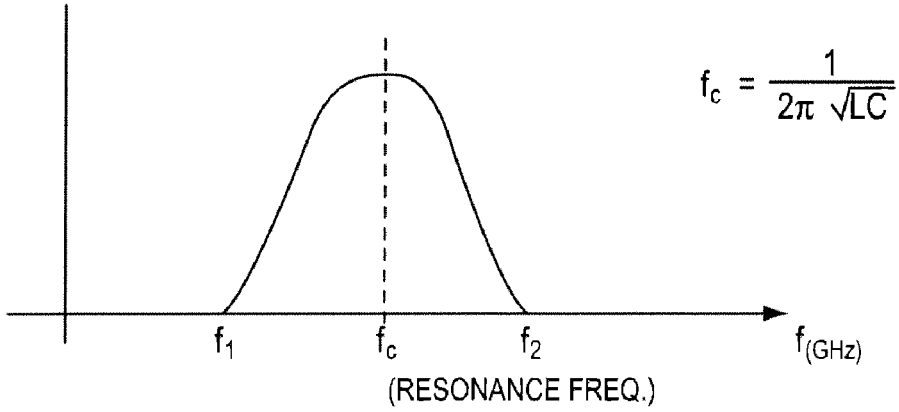

The resonance frequency, fc, is the center frequency in the frequency band. The graph of FIG. 4*b* shows the resonance frequency of the tank circuit within the frequency band, between f1 and f2. The in-band resonance or center frequency is the frequency for which the groove would be designed and is therefore at times referred to as the in-band design frequency.

Conceptually, the geometric design would be similar but the dimensions for different frequencies such as 6, 13, 15, 18, 23, 26, 28 and 38 GHz would be different. Thus, notwithstanding the different dimensions, the description of the geometric configuration applies in general to the various frequencies.

Figure 5A:
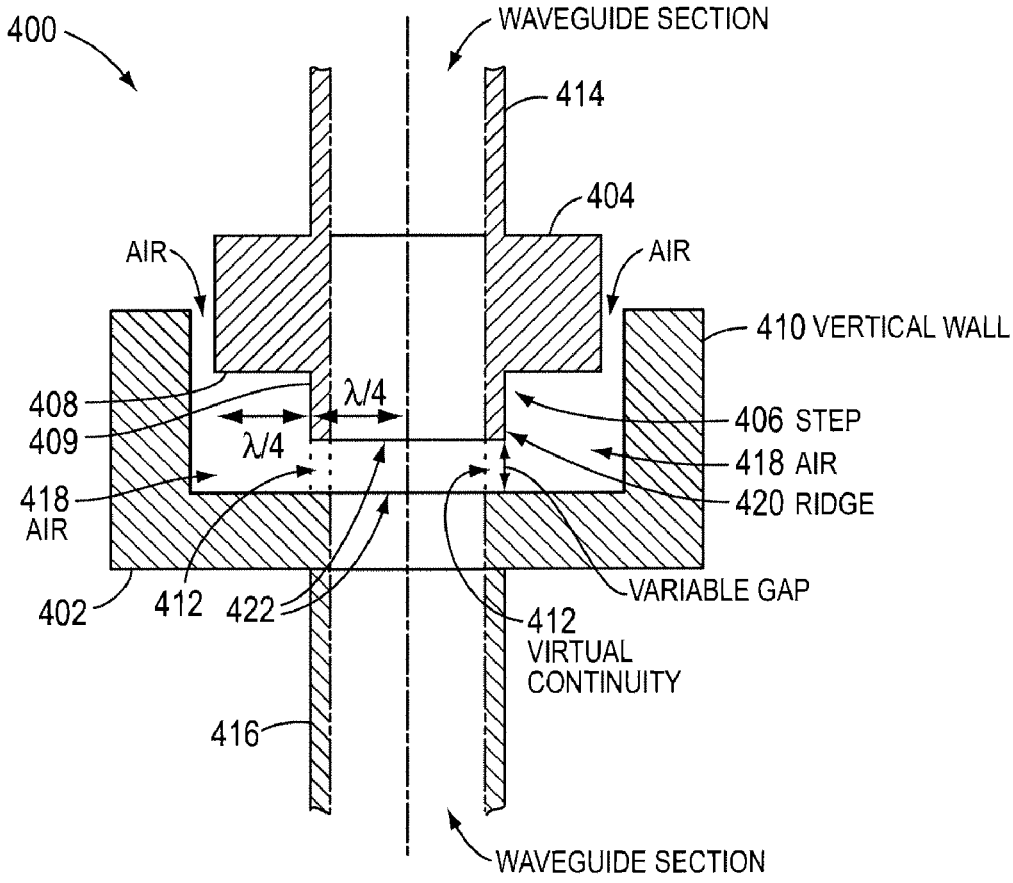
FIGS. 5*a*-5*b* illustrate a waveguide interface configured, in accordance with principles of the present invention, with a so-called step choke flange mating with a shield flange to form the joint between waveguide sections.

FIG. 5*a* is a diagram of a waveguide interface joining two waveguide sections. In accordance with principles of the present invention, this embodiment of a waveguide interface is configured to join waveguide sections 414 and 416 using flanges 402 and 404. One flange 404 is a 'choke' flange with a new step-like choke design and the second flange 402 is a 'shield' flange. Structurally, the so-called choke flange 404 has a neck 420 with a quarter-wavelength (λ/4) radius designed to accommodate a circular waveguide section or components 414. Because the body of such choke flange 404 has a half-wavelength (λ/2) radius, the neck 420 forms a step 406 at the base along the perimeter of the flange body.

The neck and step formation replaces the conventional groove surrounding the waveguide opening which is carved on the mating surface with this waveguide opening. Note that instead of a circular shape, the waveguides and flanges may have a rectangular or square-like shape. In such instances, the half-wavelength (λ/2) and quarter-wavelength (λ/4) dimensions would be maintained except that instead of radius they would be length/width dimensions. A circular-square or rectangular body shape combination is likewise possible. Note also that the dimensions are designed for a particular frequency, but, as will be later explained, because of the characteristics of this design the precision of these dimensions and the smoothness of the surfaces is not as critical as it would otherwise be in conventional designs.

Turning again to FIG. 5*a*, the horizontal face 408 and vertical faces 409 of the step 406 are opposite the horizontal and vertical walls 410 of the shield flange 402, respectively, and together they form an air gap 418 with a rectangular-like or square-like (e.g., see square 799 of FIG. 7*e* ) cross section that surrounds the neck. In instances where the flanges are circular the air gap 418 would be annual-shaped. Also, the references to horizontal and vertical orientations do not suggest that other orientations are not possible with rotation or reconfiguration of the flanges. The so-called choke flange 404 engages with vertical wall 410 of the shield flange 402 but not tightly so that air can pass through between them and fill or exit the air gap 418. However, because of the aforementioned step configuration and dimensions of the choke flange, when it mates with the shield flange the mating flanges produce at the connection points the virtual continuity effect 412 in the desired frequency range. Moreover, in addition to imprecision of the mechanical dimensions, this configuration can tolerate a variable distance (gap) between the waveguide openings that results from movement or imperfect face-to-face abutment of the horizontal mating surfaces 422. The gap between these horizontal mating surfaces 422 may reach as much 0.06" or more without materially degrading the continuity through the joint between the waveguide sections 414, 416.

Also, the mechanical block erected by the vertical walls 410 that project (vertically in this instance) from the base of the shield flange 402 operates to block energy leakage over the frequency range, say 37-41 GHz. Thus, notwithstanding the relatively loose mating between the flanges which allows air to pass through between them, the vertical walls 410 create an effect akin to an electrical energy gasket.

Figure 5B:
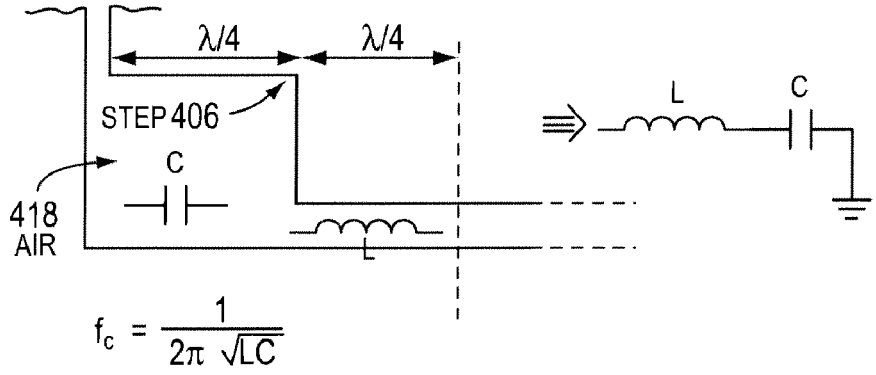

Again, the geometry of the air gap 418, ridge 420 and step surfaces 406 are designed for a particular frequency, and the resulting effects can be analogized to those of a tank (LC) circuit. FIG. 5*b* illustrates the equivalent tank circuit with the LC components. The capacitance, C, corresponds to the geometry of the air gap 418 and the inductance, L, corresponds to the geometry of the gap between the horizontal mating surfaces 422. With different LC combinations, the Q and resonance frequency, fc, of the equivalent tank circuit change and, in turn, the bandwidth changes. Thus, with mechanical dimension changes leading to changes in the LC combinations, the continuity across the waveguide joint would appear more or less complete.

Figure 6A:
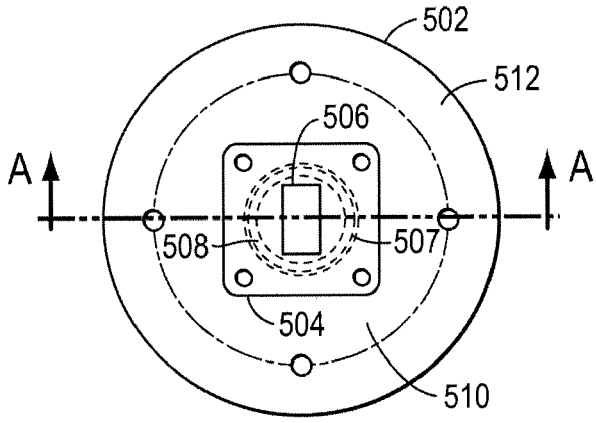
FIGS. 6*a*-6*c* and 7*a*-7*e* show various top, cross section and isometric views of waveguide interfaces to illustrate a number of embodiments of the waveguide interface design in accordance with principles of the present invention.
Figure 6B:
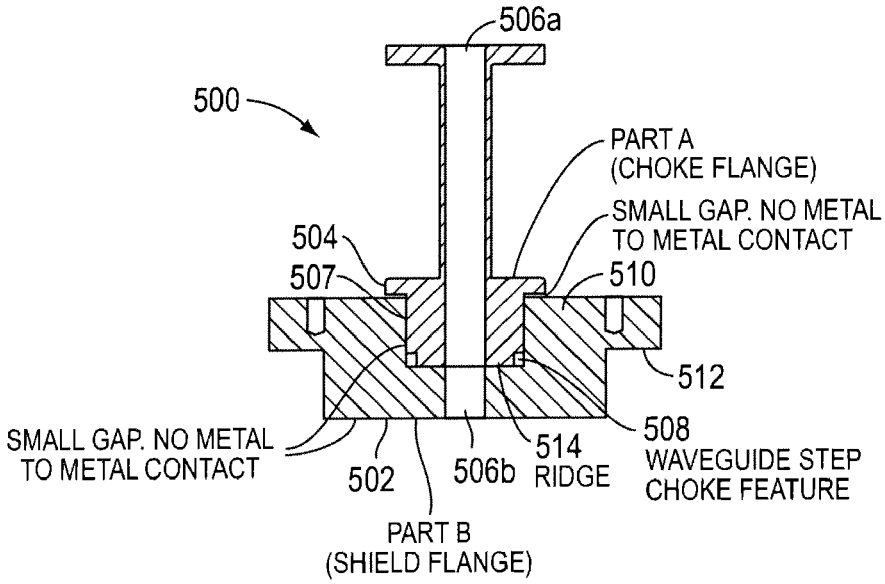
Figure 6C:
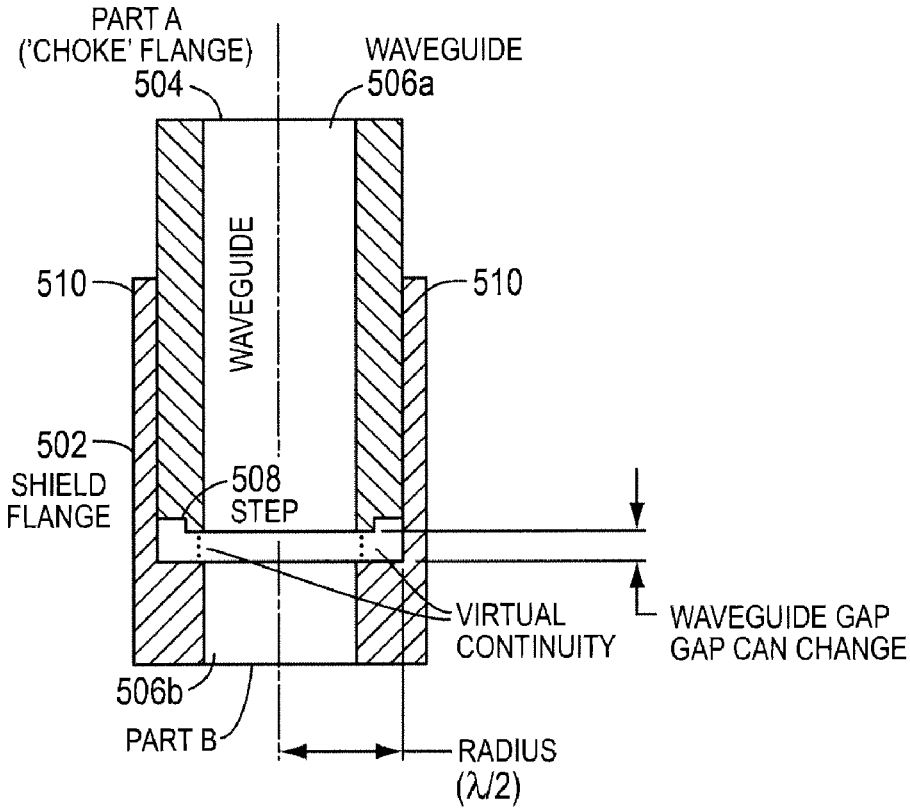

FIGS. 6*a*-6*c* illustrate an implementation of the foregoing design in a waveguide joint for interfacing two waveguide sections. FIG. 6*a* is a top-view diagram of the waveguide interface. FIG. 6*b* is a diagram of a cross section along lines A-A depicted in FIG. 6*a*. FIG. 6*c* shows parts 'a' and 'b' of the interface separated somewhat to emphasize the gap between the mating horizontal surfaces. In this instance the waveguide sections 506*a*-506*b* (see FIGS. 5*b* & 5*c*)are rectangular. The 'choke' flange 504 has a circular body with a square lip and the shield flange 502 has a circular lip and a circular body. The vertical walls 510 of the shield flange define a circular shield around the choke flange and together with the lip of the choke flange operate to block energy leakage. The annular air gap 508 is defined by the vertical and horizontal wall surfaces of the shield flange 502 and the surfaces of the step in the 'choke' flange 504.

In other words, once the frequency and corresponding dimensions are selected, a waveguide interface with the foregoing configuration would produce more predictable and robust results even with imperfect manufacture and assembly precision or subsequent movement. Such waveguide interface design relaxes or substantially avoids what would otherwise be a requirement of an effectively watertight, gap free and perfectly aligned mating between the flanges.

Note that in either one of the embodiments, whether described above or below, the height and shape of mating flange members is preferably set to enhance the mechanical and electrical performance of the waveguide interface. For instance, the height of the vertical wall members 510 of the shield flange 502 and that of the inserted choke flange member 507 is relatively large and sufficient to provide mechanical stability and improve the energy leakage blocking capability. In other words, the dimensions are preferably set for providing stable mechanical retention of the mating flange members and for sealing the joint to block energy leakage.

Figure 7A:
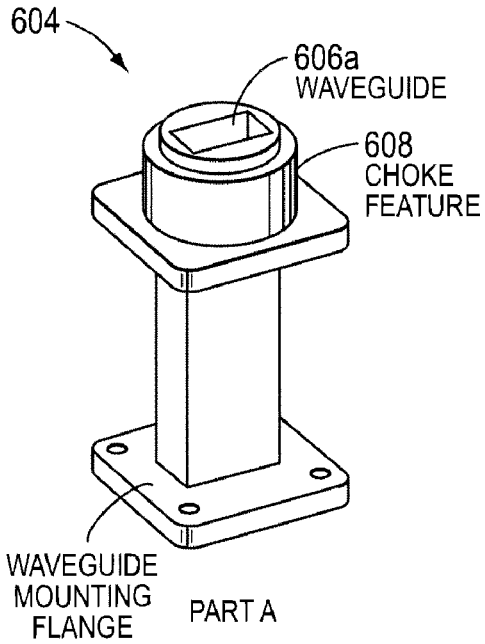
Figure 7C:
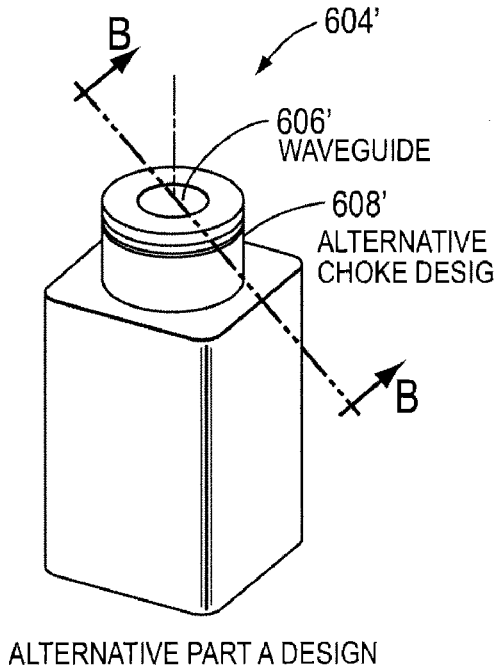
Figure 7B:
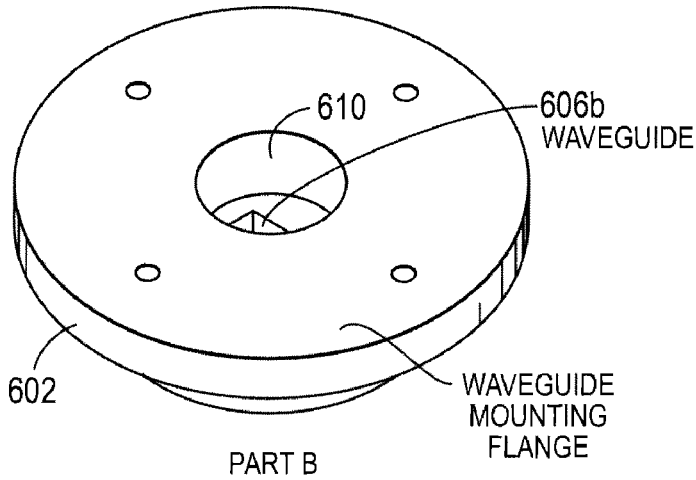

Following the same principles as described above but with a different configuration, another waveguide joint is implemented as shown in FIGS. 7*a*-*b*. With parts a and b, the interface joins two rectangular waveguide sections 606*a* (see FIG. 7*a*), 606*b*(see FIG. 7*b*). In particular, part a is the choke flange 604 with the step-choke feature 608 and part b is the waveguide mounting flange or the so-called shield flange 602. The waveguide joint would be assembled by flipping the choke flange 604 on its head and inserting it head down into the circular opening 610 of the shield flange 602 as shown in FIG. 7*b*.

FIG. 7*c* illustrates an alternate configuration for part a which is a choke flange 604'. This configuration might fit for instance in a smaller space with a different shape factor. In this implementation the waveguide interface (i.e., waveguide section 606') joins a circular waveguide in part a to a rectangular waveguide in part b (i.e., the shield flange 602 of FIG. 7*b*). Notably also, the choke feature 608' is designed with a different geometry to fit the new space requirements but to achieve similar electrical properties.

Figure 7D:
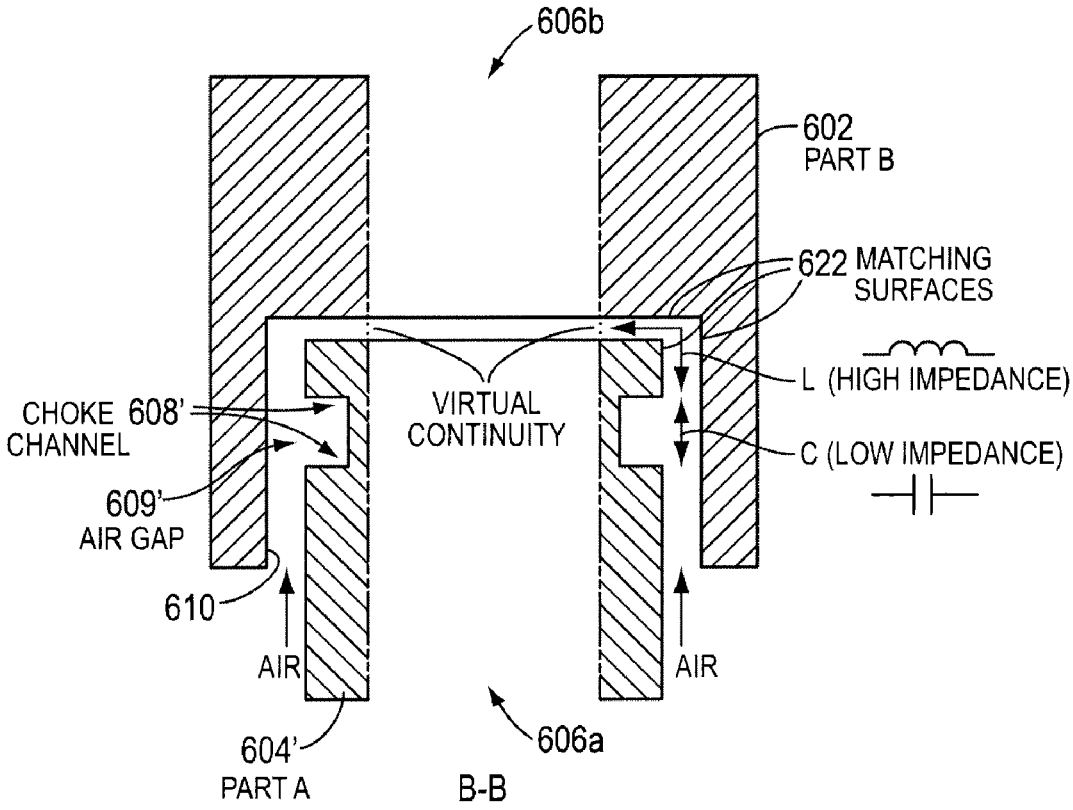
Figure 7E:
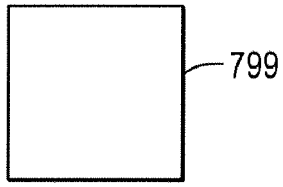

FIG. 7*d* provides a more detailed cross-section view, along line B-B, of the alternate choke design of FIG. 7*c*. The channel or groove is carved on the vertical wall and is offset from the base of the choke flange body. Here again, the offset groove on the vertical wall replaces the conventional groove which would be otherwise carved on the (perpendicular) mating surface around the waveguide opening. In this instance, when the shield flange receives the choke flange, the air gap 609' is defined between the vertical wall of the circular opening 610 in the shield flange and the choke channel 608' in the vertical side wall of the 'choke' flange 604'. The channel corresponds to an equivalent low impedance, capacitance C, and the gap between the mating surfaces 622 corresponds to an equivalent high impedance, inductance L. The channel, or groove, has a width dimension corresponding to half wavelength of the design frequency. Thus, as in the previous embodiments, with this geometry the mating of the flanges does not require air-tight metal-to-metal (ohmic) contact and the electrical properties of the waveguide joint are similar in that they produce the virtual continuity across the joint between the waveguides at the contact points.

The discontinuity between the waveguides at the connection points effects properties such as insertion loss and return loss of the combined waveguide. Thus, achieving the desired virtual continuity with the foregoing designs helps minimize the insertion loss and improve the return loss even when the face-to-face abutment of mating surfaces is not gap-free metal-to-metal contact and the gap size varies. Indeed with proper dimensions (e.g., width, step size) the design can create resonance at the desired frequency within the frequency band. In other words, with proper design of the choke, the waveguide behaves predictably in the desired frequency range even with a variable gap.

Figure 8A:
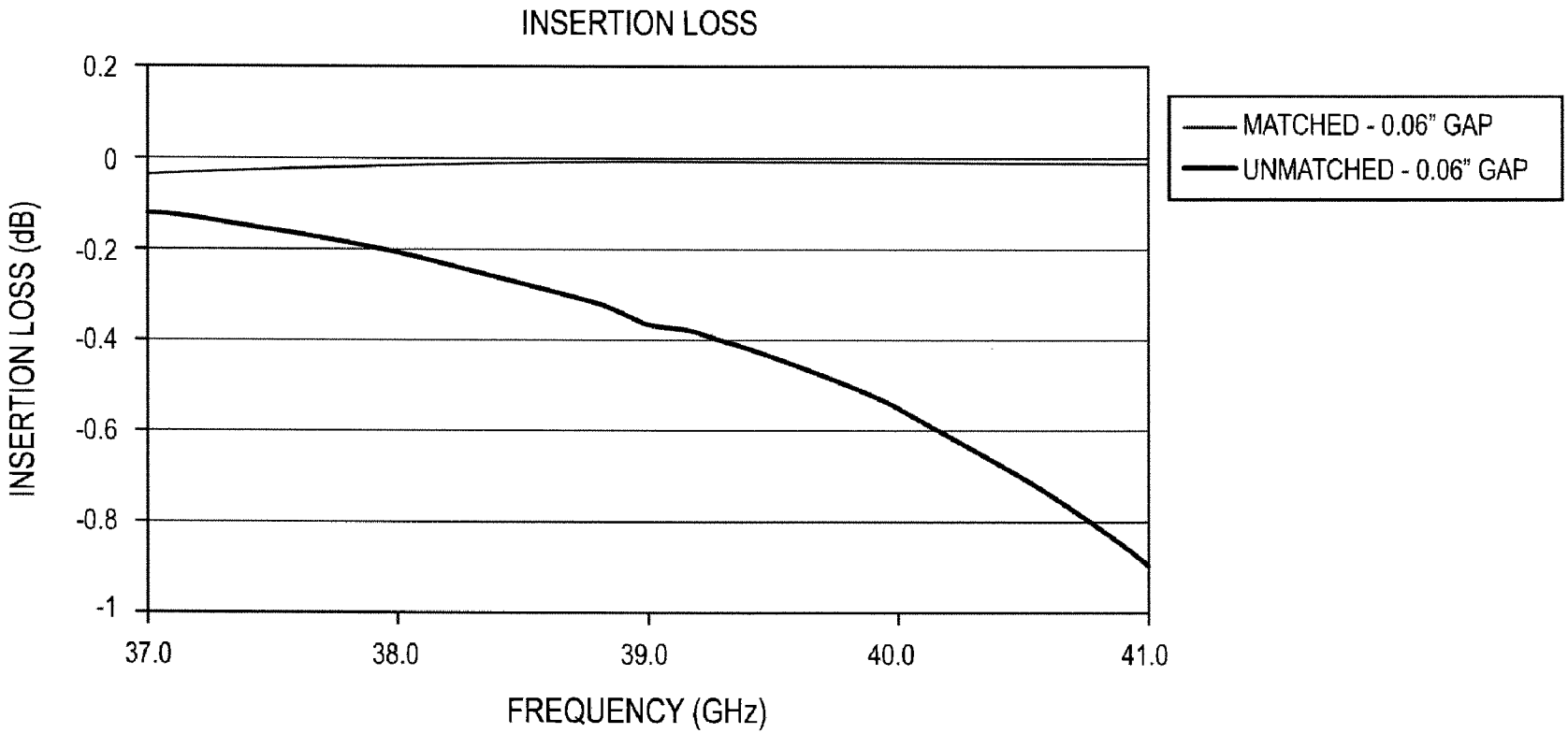
FIGS. 8*a*-8*c* are empirical insertion loss and return loss graphs.

FIG. 8*a* is a diagram showing an empirical insertion loss that would be exhibited by impedance matched and unmatched designs with a gap of 0.06". A transition with well-matched impedances produces in turn well-matched frequency responses for the various gap sizes. The unmatched impedance design uses a conventional choke-based flange configuration while the matched design uses a flange with one of the new choke designs as illustrated above. The high insertion loss shown for the unmatched design at the high end of the frequency range indicates a near-by resonance. The insertion loss with an impedance-matched design in accordance with various embodiments of the present invention is minimal and significantly closer to 0 dB.

Figure 8B:
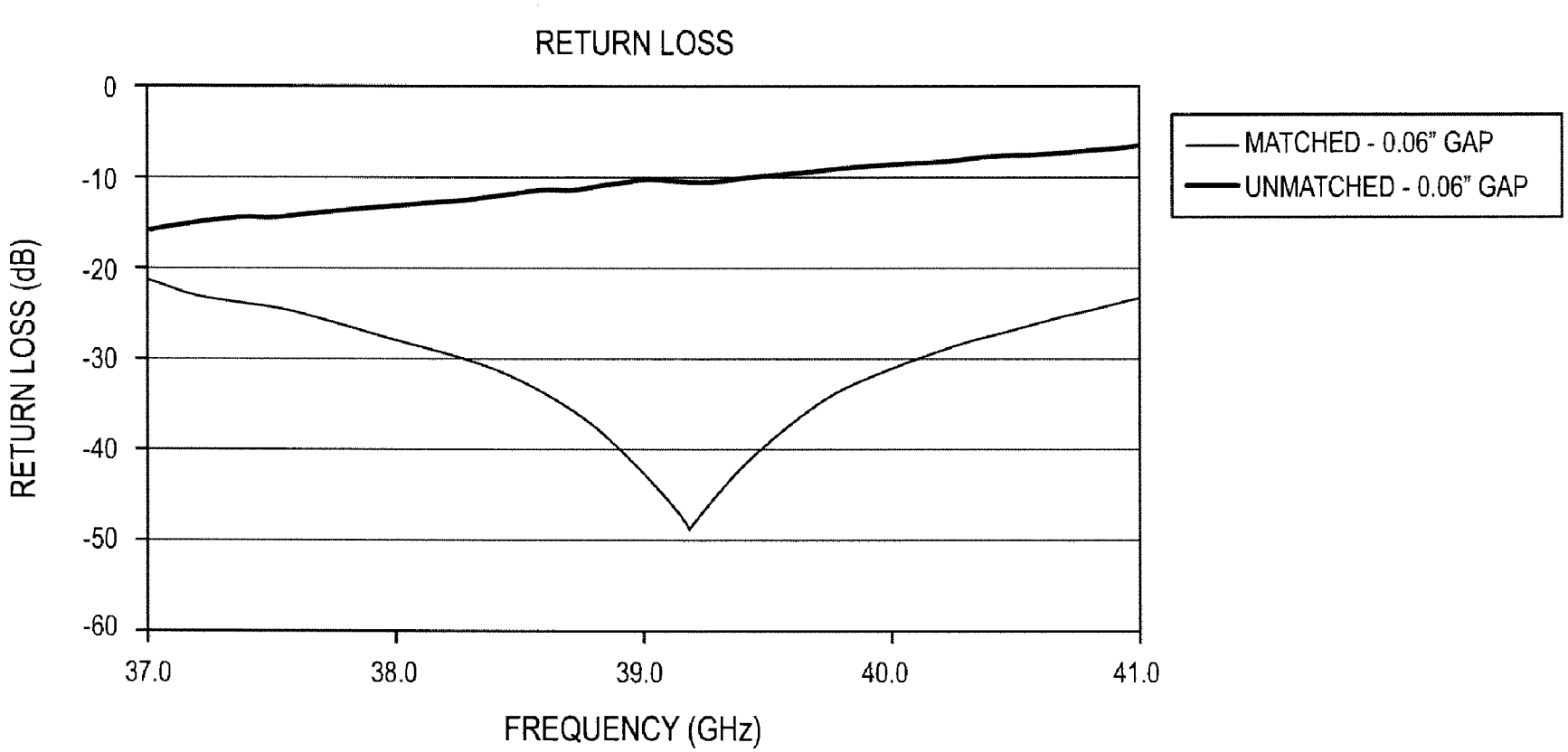
Figure 8C:
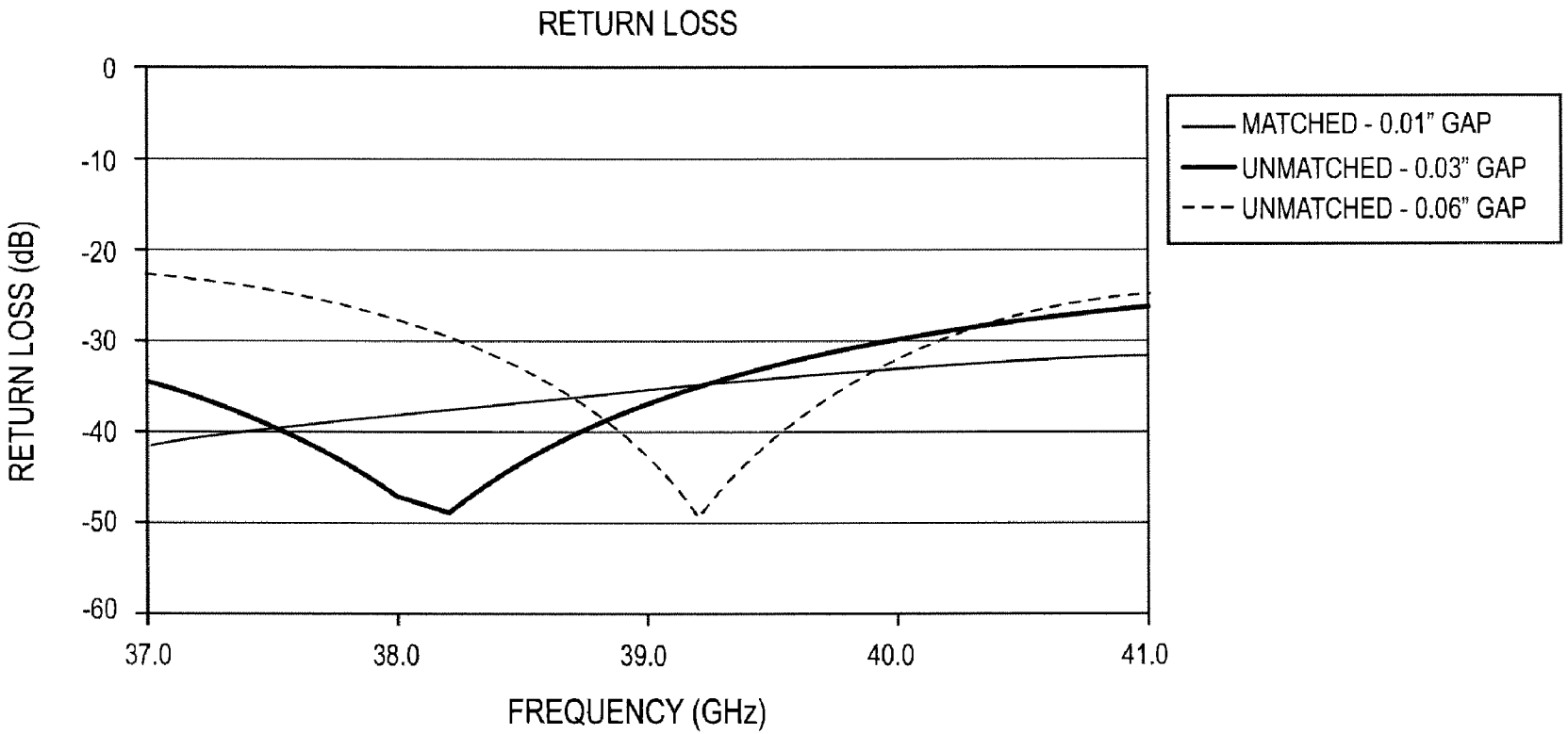

FIG. 8*b* shows empirical values for the return loss that would be obtained with impedance matched and unmatched designs. Again the unmatched designs use conventional choke-based flanges and the matched designs use one of the above-described new choke. Ideally, without the gap the desired return loss might be maintained at a level 20 dB or higher across the frequency band, but with an unmatched design the return loss for a 0.06" gap is at the lower level of 5-10 dB. With a matched design (that removes the resonance of an unmatched design) the return loss for a 0.06" gap is equal to or higher (in absolute value) than 22 dB across the frequency range. This improvement provided by the matched impedance designs should work for various gap sizes and, as shown in FIG. 8*c*, the return loss values for the various gap sizes exceed 20 dB.

In sum, waveguide interfaces implemented in accordance with the principles of the present invention have a waveguide transition which minimizes resonance that would otherwise introduce poor return loss and high insertion loss across the frequency range. These waveguide interfaces are designed to tolerate gaps between the mating surfaces of the flanges and lower levels of parts precision. In addition, these waveguide interfaces require fewer parts, having no need for the spring contacts to make the electrical connection.

It is worth mentioning that the new waveguide interface designs apply to and can be implemented to effect a connection between waveguides in any type of system or environment. For example, one of the new waveguide interface designs can be implemented to connect between a primary feed horn of a microwave antenna and diplexer in a microwave transceiver. In another example, such waveguide interface designs can be implemented in a connection between waveguides in test equipment.

Finally, although the present invention has been described in considerable detail with reference to certain preferred versions thereof, other versions are possible. Therefore, the spirit and scope of the appended claims should not be limited to the description and illustrations of the preferred versions contained herein.

What is claimed is:

1. A waveguide interface, comprising:

a choke flange associated with a first waveguide, the choke flange comprising a body and a neck, the neck having a mating face opposite the body, the mating face comprising an opening for the first waveguide, wherein a width of the body being one wavelength corresponding to a design frequency and a width of the neck being one half-wavelength corresponding to the design frequency; and a shield flange associated with second waveguide, the shield flange comprising a base and a wall projecting from the base, the base having a mating face with a waveguide opening for the second waveguide, the shield flange being configured such that the mating face of the shield flange faces the mating face of the choke flange to operatively couple the associated waveguides, wherein the neck and body of the choke flange and the base and the wall of the shield flange define an air gap.

2. The waveguide interface as in claim 1, adapted to maintain the shield and choke flanges such that air is passable therebetween.

3. The waveguide interface as in claim 2, wherein the air is passable between the shield and choke flanges such that the air may enter the air gap.

4. The waveguide interface as in claim 1, wherein the neck is substantially concentric with the body.

5. The waveguide interface as in claim 1, wherein the mating faces are each circular or rectangular shaped to accommodate the shape of the respective associated waveguide.

6. The waveguide interface as in claim 1, wherein the wall of the shield flange is configured lo create mechanical support for retaining the choke flange and to create an electrical block for preventing energy leakage.

7. The waveguide interface as in claim 1, wherein the joint between the waveguides exhibits over a frequency band insertion loss that falls below a predetermined insertion loss level and return loss that exceeds a predetermined return loss level even when a variable gap between the waveguide openings varies in size.

8. The waveguide interface as in claim 1, wherein a variable gap between the waveguides varies in size from 0.00" to 0.06".

9. The waveguide interface as in claim 1, wherein the air gap and a variable gap between the waveguides function in a manner equivalent to a tank circuit with a center frequency substantially equal to the design frequency.

10. The waveguide interface as in claim 1, wherein the air gap has a shape with a square cross section.

11. The waveguide interface as in claim 1, wherein a virtual continuity is formed between the associated waveguides, the virtual continuity representing a matched impedance that translates to a matched frequency response.

12. The waveguide interface as in claim 1, wherein the neck has a quarter wavelength radius.

* * * * *